US006554209B2

(12) United States Patent
Djordjevic

(10) Patent No.: US 6,554,209 B2
(45) Date of Patent: Apr. 29, 2003

(54) COMBINATION HOSE NOZZLE AND LAWN SPRINKLER

(75) Inventor: Simeon Djordjevic, Suite 202, 125 West Keith Road, North Vancouver, British Columbia (CA), V7M 1L2

(73) Assignee: Simeon Djordjevic, North Vancouver (CA)

( * ) Notice: Subject to any disclaimer, the term of this patent is extended or adjusted under 35 U.S.C. 154(b) by 0 days.

(21) Appl. No.: 09/731,886

(22) Filed: Dec. 6, 2000

(65) Prior Publication Data

US 2002/0074428 A1 Jun. 20, 2002

(51) Int. Cl.[7] ..... A62C 31/22; A62C 31/00; B05B 3/04; B05B 3/06

(52) U.S. Cl. ..... 239/276; 239/240; 239/255; 239/444

(58) Field of Search ..... 239/436, 1, 437, 239/438, 440, 443, 444, 447, 452, 242, 457, 276, 587.1, 587.2, 587.5, 201, 200, 203, 205, 206, 569, 255, DIG. 15, 240, 271, 272; 137/498, 519, 519.5

(56) References Cited

U.S. PATENT DOCUMENTS 1,084,843 A * 1/1914 Byler ..... 239/444
1,566,232 A 12/1925 Schreiter
1,854,201 A * 4/1932 Kobayashi ..... 239/444
3,144,878 A * 8/1964 Williams ..... 239/444
3,176,924 A * 4/1965 Canavan ..... 239/444
3,601,316 A * 8/1971 Murray ..... 239/222.17
4,407,455 A * 10/1983 Sargent ..... 239/261
5,090,621 A * 2/1992 McMillen et al. ..... 239/230
5,160,093 A 11/1992 Battaglia

* cited by examiner

*Primary Examiner*—Michael Mar
*Assistant Examiner*—Davis Hwu
(74) *Attorney, Agent, or Firm*—John Russell Uren

(57) ABSTRACT

A combination hose nozzle and lawn sprinkler which is operable both as a hose nozzle by a user and as a lawn sprinkler when ground mounted. An internal jet and a member define a passageway for water to be directed from the passageway in a first configuration. A plurality of orifices are closed when the water is directed from the passageway in the first configuration and are open in a second configuration when the combination is used as a lawn sprinkler. A protuberance is provided for ground mounting. The orifices are provided in a member that may rotate when the combination is used in the ground mounted configuration.

4 Claims, 6 Drawing Sheets

COMBINATION HOSE NOZZLE AND LAWN SPRINKLER

INTRODUCTION

This invention relates to a combination hose nozzle and lawn sprinkler and, more particularly, to a combination hose nozzle which will convert to a rotary lawn sprinkler during ground mounted operation.

BACKGROUND OF THE INVENTION

Hose nozzles have been designed to be used on a hose as a nozzle and as a sprinkler when ground positioned, sometimes with controls that allow on-off operation and controlled quantity water release. The sprinkler operation utilises the nozzle which has one end which releases water and with the opposite end having a spike or other protuberance which can readily be inserted into the ground thereby allowing water to be dispensed without the necessity of a user holding the nozzle. Such a nozzle is illustrated and described in U.S. Pat. No. 1,566,232 (Schreiter) and U.S. Pat. No. 5,160,093 (Battaglia).

The lawn sprinkler aspect of the aforementioned nozzles suffers disadvantages. In the '232 patent, the nozzle when inserted into the ground and operating without the user holding the nozzle, sprays water in only one direction. This reduces uniform lawn coverage In the '093 patent, the nozzle, after being inserted into the ground, requires the user to terminate the operation of the nozzle and to commence operation from the sprinkler. Further, the sprinkler from which the water emanates when the sprinkler is used in the ground has a fixed spray. The fixed spray causes portions of the ground surface to receive more water than other portions. This uneven coverage contributes to different growth rates of the lawn and/or areas being watered.

SUMMARY OF THE PRESENT INVENTION

According to one aspect of the invention, there is provided a combination hose nozzle and water sprinkler for mounting on a hose and comprising handle and nozzle portions, said handle portion having an inlet area for mounting on said hose, said nozzle portion being connected to said handle portion and allowing for water communication there between, said nozzle portion comprising orifices to allow water to be directed out of said orifices when said orifices are open and a passageway between a third member and an internal jet to allow water to be directed out of said passageway when said orifices are closed.

According to a further aspect of the invention, there is provided a method of directing water flow from a combination hose nozzle and ground sprinkler comprising the steps of mounting said combination hose nozzle and ground sprinkler on said hose, directing water in a first direction from said combination hose nozzle and ground sprinkler when said hose nozzle and ground sprinkler is held by a user, inserting said hose nozzle and ground sprinkler into ground by use of a protuberance and directing water in a substantially 360 degree pattern from said hose nozzle and lawn sprinkler when said hose nozzle and lawn sprinkler is inserted into said ground.

BRIEF DESCRIPTION OF THE SEVERAL VIEWS OF THE DRAWINGS

Specific embodiments of the invention will now be described, by way of example only, with the use of drawings in which.

DESCRIPTION OF SPECIFIC EMBODIMENT

Figure 1:
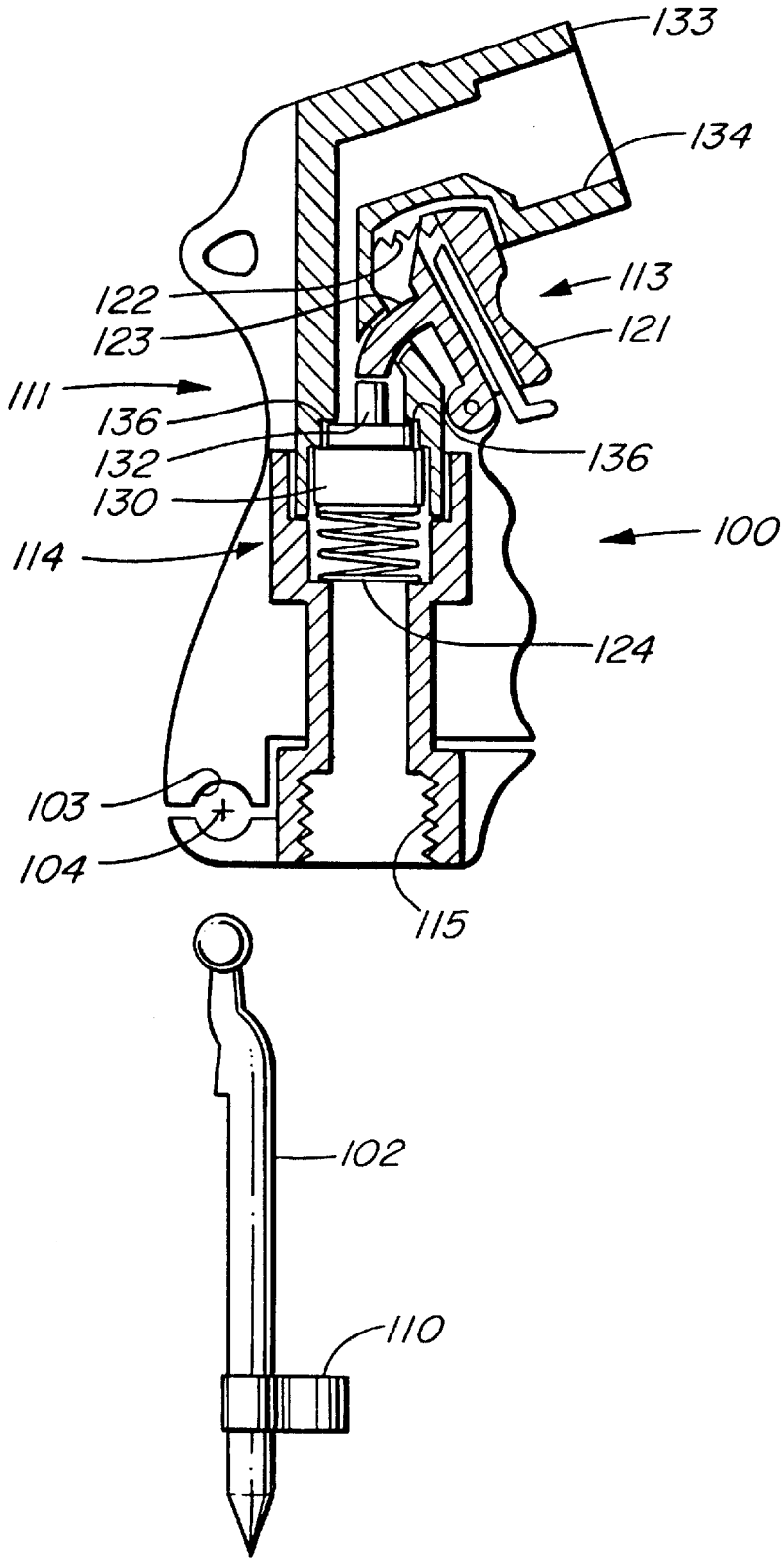
FIG. 1 is a diagrammatic exploded side partial sectional view of the combination hose nozzle and lawn sprinkler according to the invention.
Figure 2:
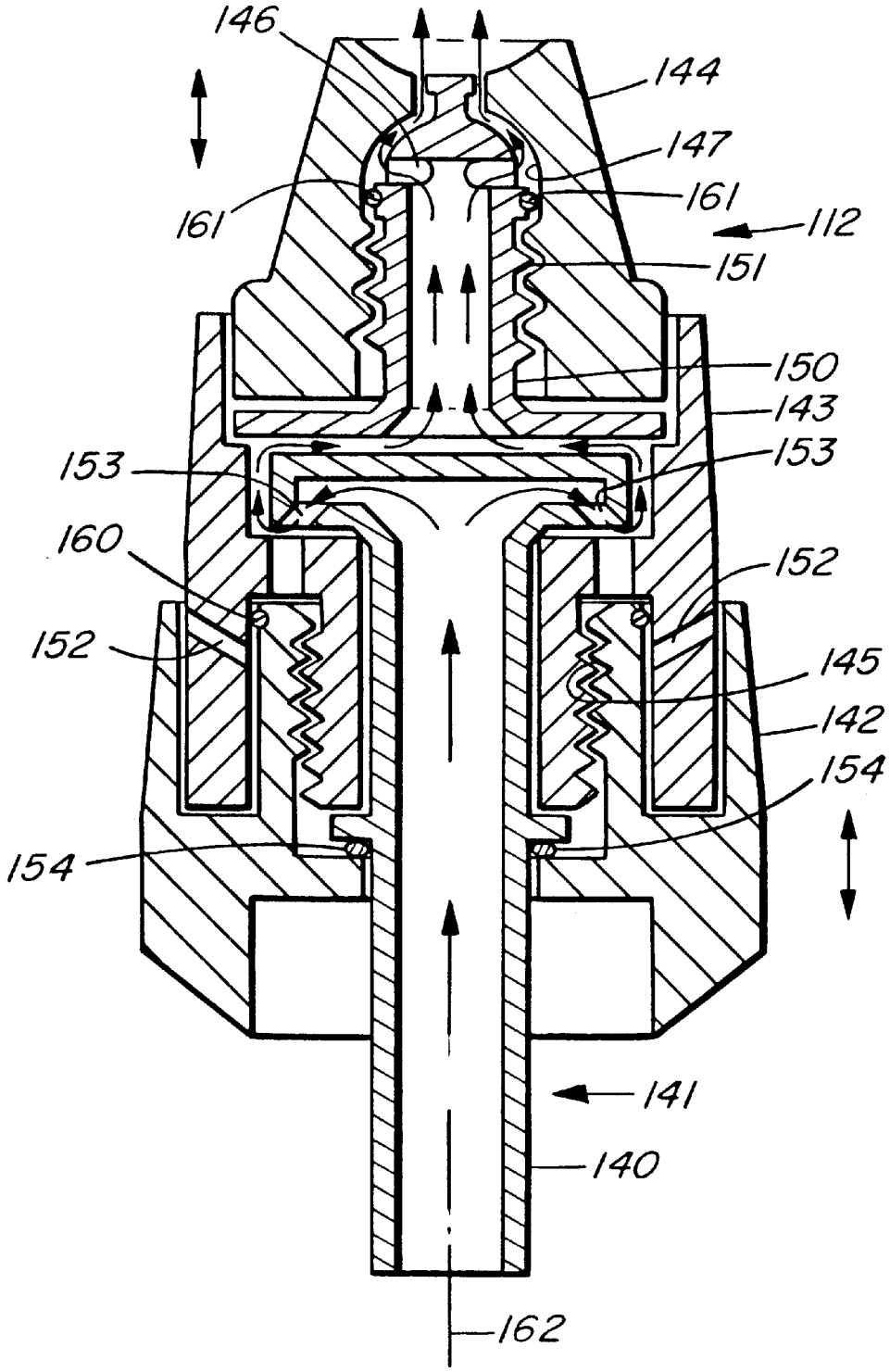
FIG. 2 is a diagrammatic side sectional view of the nozzle portion of the hose nozzle and lawn sprinkler of FIG. 1 with the sprinkler orifices in a closed position thereby directing water in a first direction as desired by a user.
Figure 3:
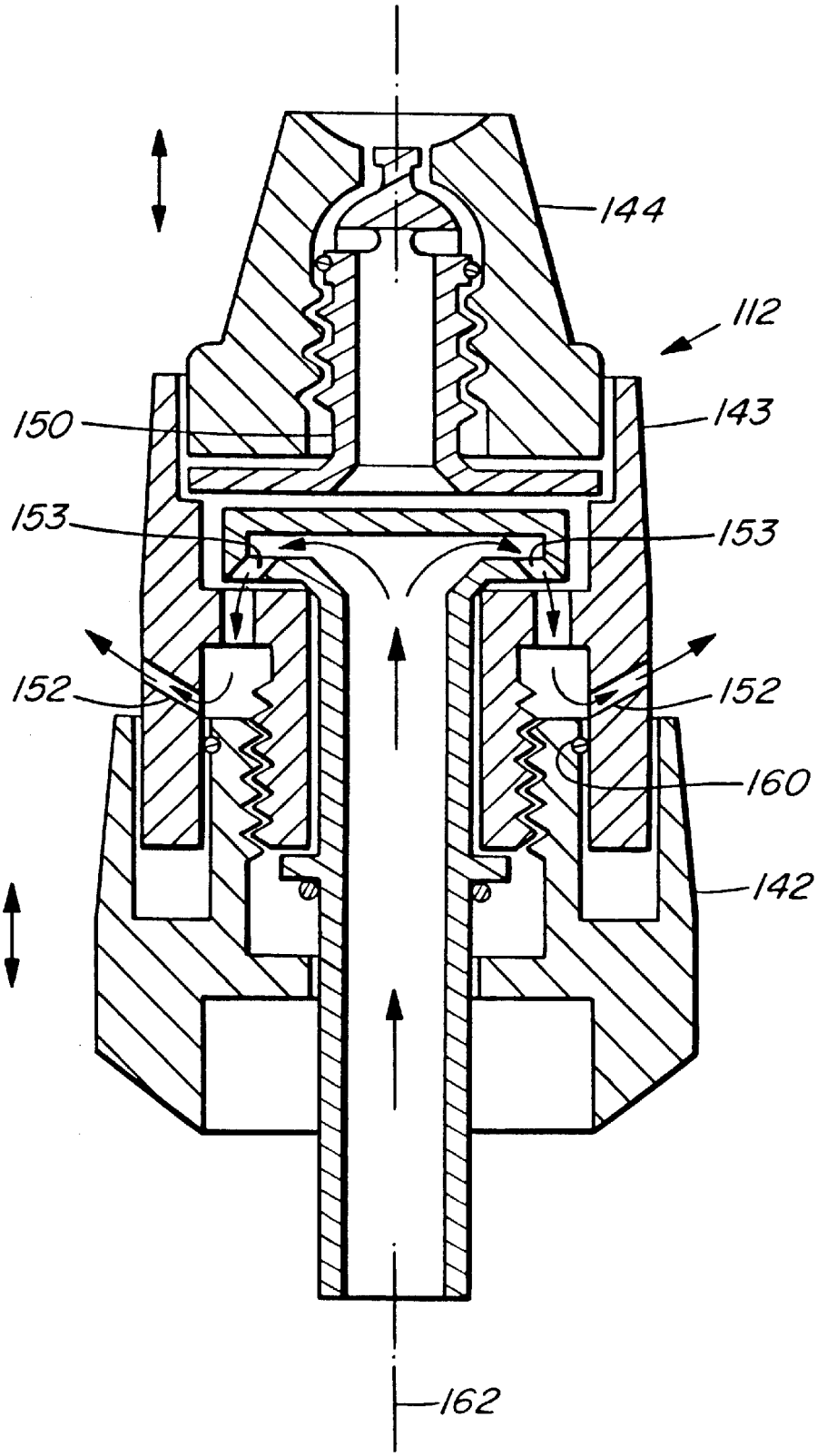
FIG. 3 is a diagrammatic side sectional view of the nozzle portion similar to FIG. 2 but illustrating the sprinkler orifices in their open position wherein the lawn sprinkler configuration is utilised.
Figure 4A:
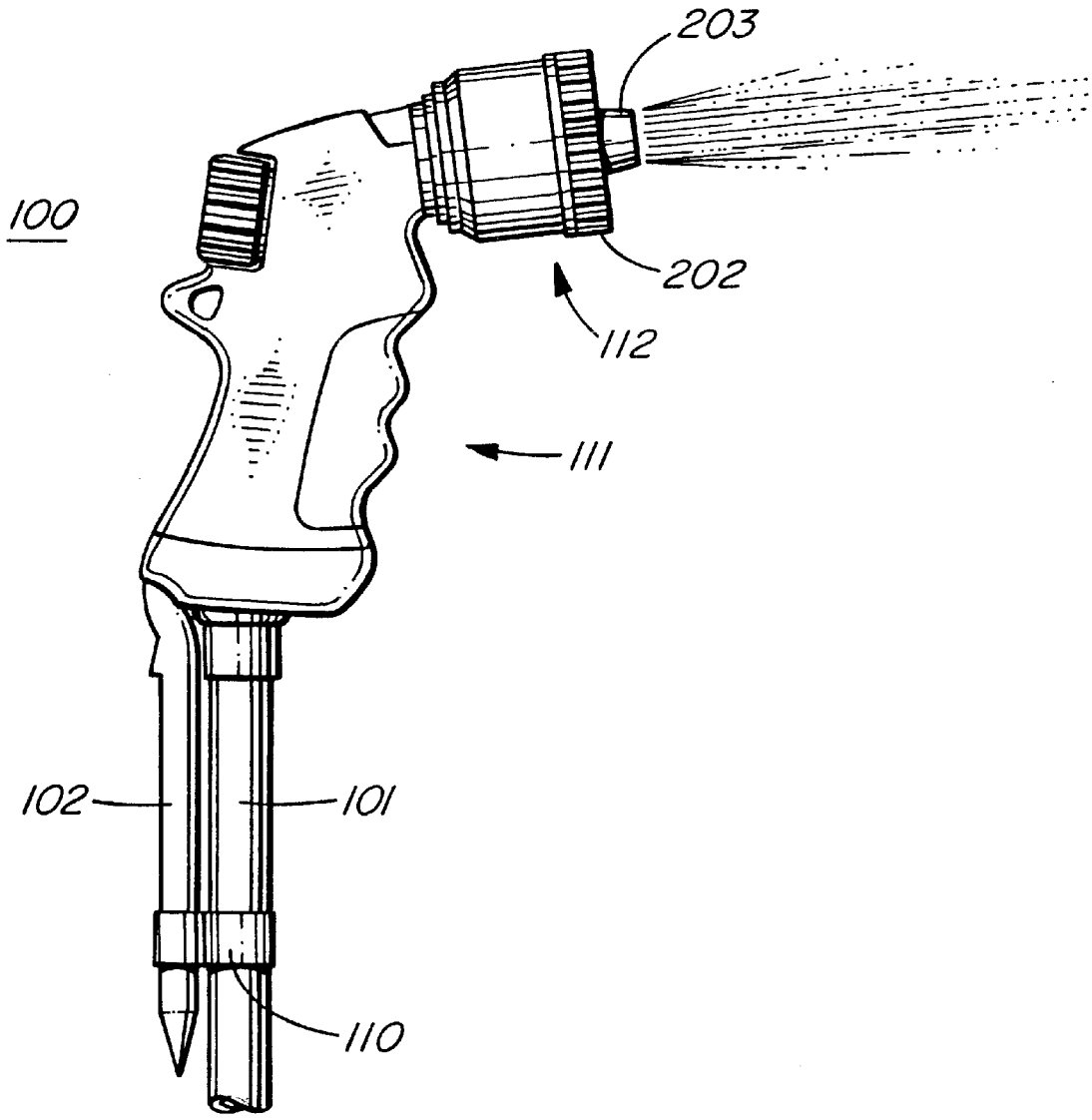
FIGS. 4A and 4B are side views diagrammatically illustrating the hose nozzle and lawn sprinkler in its hose mounted user held and ground mounted positions, respectively.
Figure 4B:
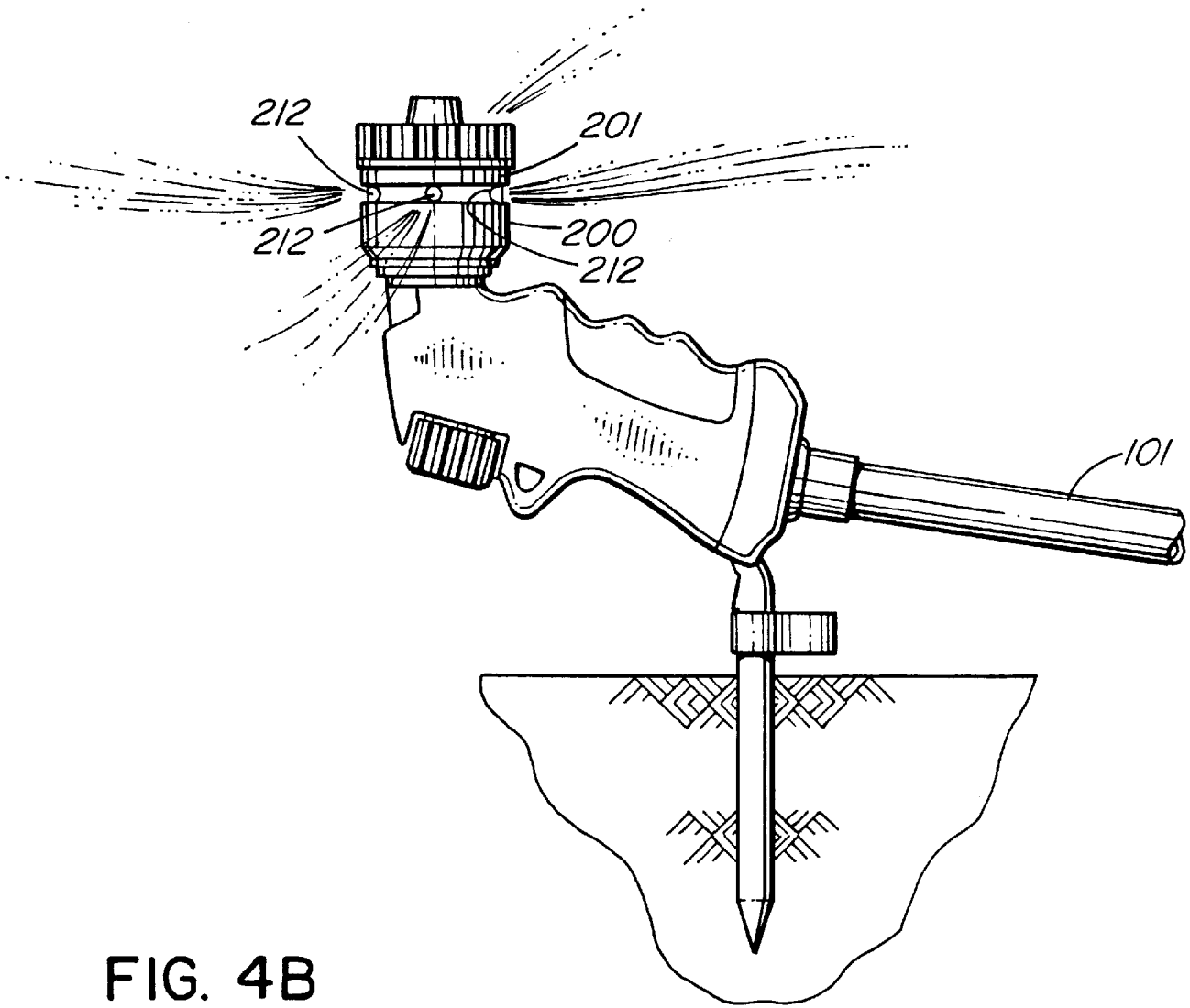

Referring now to the drawings, a combination hose nozzle and lawn sprinkler according to the present invention is generally illustrated at 100 in FIG. 1. The combination includes a handle portion generally illustrated at 111, a protuberance 102 for insertion into the ground and a nozzle portion generally illustrated at 112 (FIGS. 2 and 3). In assembled condition, the nozzle portion 112 and the protuberance 102 are assembled to the handle portion 111 as best illustrated in FIGS. 4A and 4B. The protuberance 102 is inserted into a cylindrical recess 103 in the handle portion 112 and rotates about axis 104. An expandable keeper 110 is conveniently molded integral with the protuberance 102 using a plastic material and is used for maintaining the position of the protuberance 102 on the hose 101 as is shown in FIG. 4A thereby to prevent the protuberance 102 from undesired movement when the hose nozzle and lawn sprinkler 100 is being held manually by a user.

The handle portion 111 comprises two principal elements using movable parts, namely a trigger generally illustrated at 113 and a valve generally illustrated at 114. The trigger 113 is adapted to be conveniently rotated about axis 120 by the forefinger of a user's hand. An axial movable locking pawl 121 moves relative to trigger 113 into contact with teeth 122 complementary to the locking pawl 121 so that the trigger 113 may be temporarily locked in position thereby to direct a desired quantity of water until the locking pawl 121 is disengaged from the teeth by moving the trigger 113. Trigger 113 includes an extension 123 which contacts valve 114 when the trigger 113 is rotated about axis 120 thereby to open or close valve 114 as the user may desire.

Valve 114. is spring biased by spring 124. Thus, when spring 124 is in its extended position, the circumference of cap 131 will be in contact with shoulders 136. This prevents water from flowing past valve 114 resulting in no water being released from the nozzle and sprinkler 100. When valve 114 is opened as contact is made between extension 123 and cap 132 of valve 114, the cap 131 and piston 130 will move downwardly and water will pass the valve 114 to be released from the nozzle and sprinkler 100 as will be described.

The outlet end 133 of the handle portion 111 is adapted to receive the nozzle 112 (FIG. 2). The outlet end 133 has a cylindrical inside 134 which is adapted to receive the diameter 140 of the nozzle valve generally illustrated at 141. The diameter 140 of nozzle valve 141 is conveniently glued or otherwise attached to the inside 134 of the outlet 133 of handle portion 111.

The nozzle portion 112 includes first, second and third circumferential members 142, 143 and 144, respectively. Both first and third circumferential members 142, 144, may be rotated relative to nozzle valve 141. First and second circumferential members 142, 143 have interconnecting internal threads 145 so that when first member 142 is manually rotated, it will move axially relative to second member 143 upwardly and downwardly as desired. Third member 144 is interconnected with an internal jet member 150 by way of threads 151 such that when third member 144 is manually rotated, third member 144 will move axially upwardly or downwardly as shown by the arrows relative to the internal jet member 150. This axial adjustment of third member 144 relative to jet member 150 is intended to provide adjustment for the water being directed outwardly between the jet member 151 and the third member 144 which will affect the spray pattern of the water.

Second member 143 is rotatable with first member 142 relative to nozzle valve 141. A plurality of orifices 152 extend through second member 143 as is illustrated. The orifices 152 are formed at an angle relative to a radial extending outwardly from axis 162 thereby to provide the propulsion force for rotation of the first and second members 142, 143 when water is being discharged through the orifices 152. Nozzle valve 141 also has a plurality of orifices 153 formed in its upper end thereby providing for external communication for the water inside valve 141 during operating conditions. A plurality of o-rings 154, 160, 161 are provided to assist water flow and to provide sealing. O-ring 154 is positioned between land 162 on nozzle valve 141 and first member 142. O-ring 160 is provided between first member 142 and second member 143 and o-ring 161 is provided between internal jet member 150 and third member 144.

Operation

In operation, it will initially be assumed that the user wishes only to direct water outwardly from the nozzle portion 112 as illustrated in FIG. 4A. In this configuration, the nozzle portion 112 will be in the CLOSED configuration as is illustrated in FIG. 2.

Water will enter the handle portion 111 through the hose 101 which is connected to the handle portion 111 by way of threads 115. In this configuration, the protuberance 102 will be connected to the hose 101 by keeper 110 as illustrated in FIG. 4A. The user will pull trigger 113 which opens valve 114 against the force of spring 124 and water will flow through the handle portion 111 to the outlet end 133 and then internally of the nozzle valve 141 (FIG. 2). The water will flow out of orifices 153 in nozzle valve 141 and, due to the sealing action of o-ring 160 and threads 145, the water will then travel around the upper diameter of nozzle valve 141 and pass upwardly within internal jet 150. The water will leave through orifices 146 in internal jet 150 and leave by way of passageway 147 between internal jet 150 and third member 144. If the spray pattern of the water is to be adjusted, third member 144 is rotated relative to internal jet 150 which will allow the diameter of the water stream leaving the passageway 147 to be changed as desired by the user.

It will now be assumed that the user wishes to use the hose nozzle and lawn sprinkler 100 in its lawn sprinkler configuration. The keeper 110 of protuberance 102 will leave contact with hose 101 and protuberance 102 will be rotated about axis 104 until it reaches the position illustrated in FIG. 4B. The trigger 113 will remain in the off position as shown in FIG. 1. Therefore, no water will be flowing through the handle portion 111. Second member 143 will be manually rotated relative to first member 142 until the configuration illustrated in FIG. 3 is assumed; that is, the orifices 152 are now open and not closed by first member 142 as shown in the FIG. 2 embodiment. Third member 144 will be rotated until it contacts the head of internal jet 150 thereby to prevent water flow from passageway 147.

The protuberance 102 is pushed into the ground and the trigger 113 is pulled to allow water to flow to the nozzle portion 112. The water will travel through nozzle valve 141 similarly to the water travel as illustrated in the FIG. 2 embodiment and will leave the nozzle valve 141 through orifices 153. Since the o-rings 160 are not now blocking water movement through orifices 152, the water will leave orifices 152. Orifices 152 are formed at an internal angle relative to a radial extending from axis 162 thereby to provide a rotational force to second member 143. Since second member 143 rotates about axis 162 together with first member 142, the entire nozzle portion 112 will rotate relative to nozzle valve 141. A rotary spray pattern will result thereby providing uniform coverage of the water to the lawn within the diameter of the spray pattern now established. Trigger 113 can, of course, be operated to initiate or terminate water flow from the nozzle portion 112 as the user may desire and the trigger 113 can likewise increase or decrease water flow.

Figure 5:
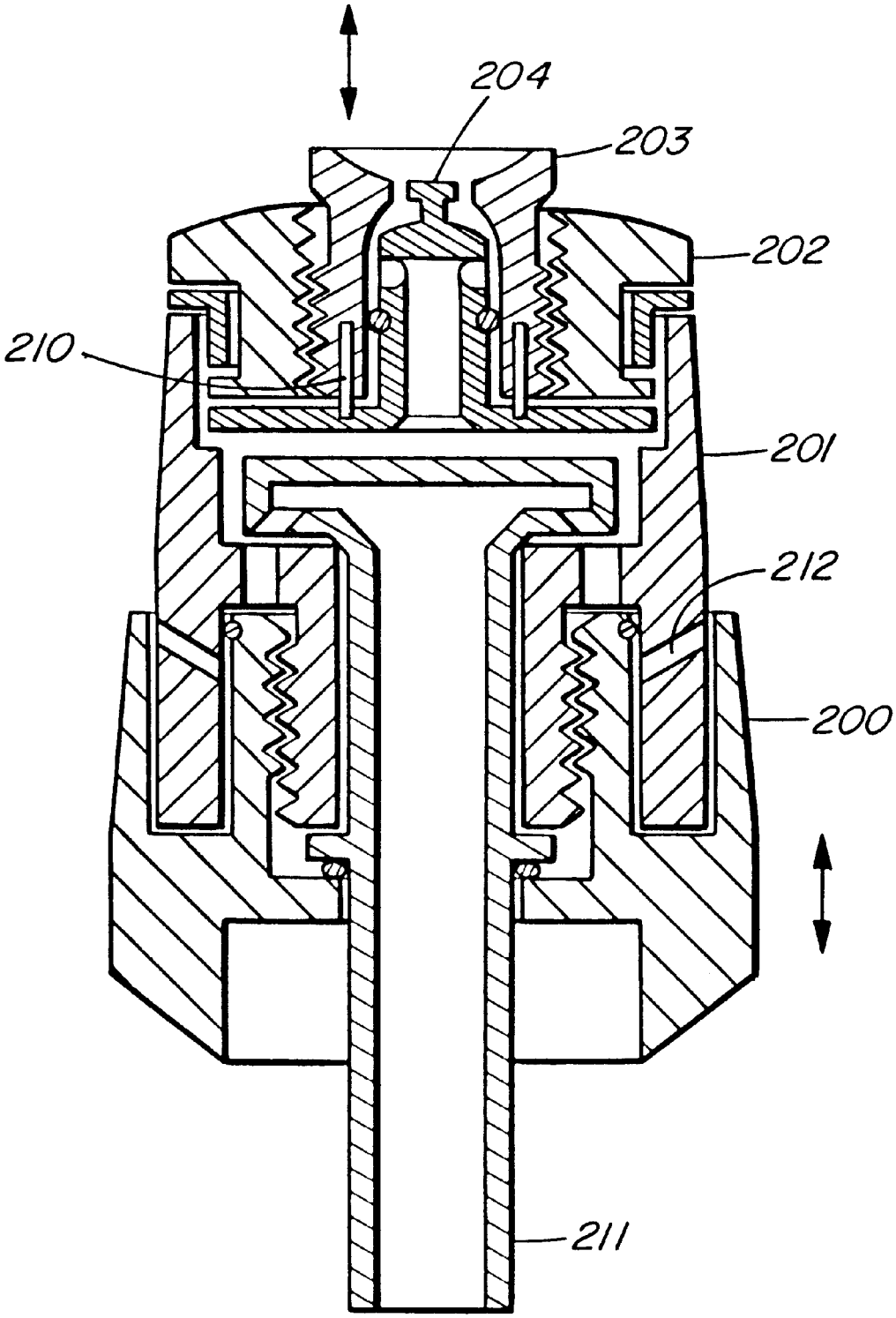
FIG. 5 is a diagrammatic side sectional view of the nozzle portion of the hose nozzle and lawn sprinkler according to a further aspect of the invention.

A further embodiment of the invention is illustrated in FIG. 5. In this embodiment, while the configuration of first member 200 and second member 201 remain substantially identical to the previous embodiment of FIGS. 2 and 3, the configuration of the third member 202 and the internal jet 204 has changed. Whereas in the FIGS. 2 and 3 embodiments, the rotation of third member 144 provides axial movement for the third member 144, by rotating third member 202 in the FIG. 5 embodiment, a jet circumferential member 203 will move relative to the internal jet 204. A spline 210 is positioned between internal jet 204 and jet circumferential member 203 to prevent relative rotational movement between the internal jet 204 and the jet circumferential member 203.

Many changes may readily be contemplated by those skilled in the art. If rotational movement of the first and second members 200, 201 relative to the nozzle valve 211 is not desired, a spline (not illustrated) could be added between the nozzle valve 211 and one of the first and second members 200, 201. Thus, the orifices 212 could still be open for water emission by rotating the second member 201 and thereby moving first member 200 axially relative thereto but rotation of the two members 200, 201 relative to nozzle valve 211 would not occur. This would affect spray pattern from the orifices 212 on the lawn in which the nozzle and sprinkler 100 is mounted but the orifice design could be such as to improve water emission consistency with, say, an upper and lower plurality of orifices extending about the circumference of second member 201.

Many further changes will readily occur to those skilled in the art to which the invention relates and the specific embodiments described should be taken as illustrative of the invention only and not as limiting its scope which should be defined in accordance with the accompanying claims.

I claim:

1. A combination hose nozzle and water sprinkler for mounting on a hose and comprising handle and nozzle portions, said handle portion having an inlet area for mounting on said hose, said nozzle portion being connected to said handle portion and allowing for water communication there between, said nozzle portion comprising a plurality of orifices to allow water to be directed out of said orifices when said orifices are open so as to allow for rotation of said orifices relative to said handle portion and a passageway between a third member and an internal jet to allow water to be directed out of said passageway when said orifices are closed.

2. Combination as in claim 1 and further comprising a ground entering protuberance for allowing said handle and nozzle portions to be mounted in said ground.

3. Combination as in claim 2 wherein said internal jet and said third member are relatively movable.

4. Combination as in claim 1 and further comprising a valve to allow water flow to be terminated or to be initiated operable associated with said handle portion.

* * * * *